US005393259A

United States Patent [19]

Lee

[11] Patent Number: 5,393,259

[45] Date of Patent: Feb. 28, 1995

[54] ACTUATED TOY DEVICE OF SANTA CHARACTER SLEEPING IN BED

[75] Inventor: Stephen Lee, Taiepei, Taiwan, Prov. of China

[73] Assignee: Telco Creations, Inc., Hicksville, N.Y.

[21] Appl. No.: 287,948

[22] Filed: Aug. 9, 1994

[51] Int. Cl.[6] ..... A63H 3/28; A63H 13/00

[52] U.S. Cl. ..... 446/298; 446/358; 40/414

[58] Field of Search ..... 446/297, 298, 309, 308, 446/358, 352, 353, 359, 322; 40/414

[56] References Cited

U.S. PATENT DOCUMENTS 2,990,646 7/1961 Berger ..... 446/353 X 5,331,110 7/1994 Chen ..... 446/298 X

*Primary Examiner*—Mickey Yu

*Attorney, Agent, or Firm*—Martin Smolowitz

[57] ABSTRACT

An actuated toy device including a recognizable character such as a Santa Claus doll reclining in a bed. The doll character chest portion is moved up and down vertically by a battery-powered gear unit through a first linkage mechanism provided in a housing attached below the bed, so as to simulate breathing action by the doll. The toy device includes an audio unit mounted in the housing. Also a second linkage mechanism is provided and arranged to periodically raise the doll head and torso portions upward from a reclining position to a near sitting position and then fall back to the reclining position in the bed.

9 Claims, 5 Drawing Sheets

15
42
26
20
22a
22
23
18
29
27
19
21
16
14

15
20
42
26
24
25
16
23
29
22
18
28
27
21b
21a
21
19
14

ACTUATED TOY DEVICE OF SANTA CHARACTER SLEEPING IN BED

BACKGROUND OF INVENTION

This invention pertains to an actuated toy device of a Santa character sleeping in a bed. It pertains particularly to such a toy device in which a sleeping Santa Claus figure emits simulated snoring sounds and periodically rises from a reclining position to a sitting position in the bed.

Many toys having animal or human form and including Santa Claus characters have been developed in the past for seasonal decorative and display purposes, in which the character is stationary. Other toys have been developed in which a known toy character is provided with an audio device which can play a musical melody or speak. However, a market need exists for improvements in recognizable actuated toy devices such as a Santa Claus character which has both audio sounds and characteristic movements which are realistic.

SUMMARY OF INVENTION

This invention provides an actuated toy device including an elongated bed structure having end and center support parts, and in which bed a recognizable character such as a Santa Claus figure reclines in the bed and has its body portion covered by a covering sheet. The bed also includes a housing mounted below the bed center support part, which housing contains a gear and linkage mechanism and an electric power source for causing the chest portion of the character to rise and fall periodically to simulate breathing and snoring sounds. The gear and linkage mechanism also causes the head and shoulder torso portion of the character to be periodically raised to a sitting position and lowered to a reclining position in the bed. The invention also includes audio means adapted for emitting periodic simulated snoring sounds for the Santa Claus character, the sounds being synchronized with the simulated breathing action of the character.

This invention advantageously provides an improved actuated toy device such as a Santa Claus character or figure in which the toy device realistically simulates breathing action and snoring sounds, and also periodically raises its head and upper torso portion from a reclining position to a raised position in a bed. Such realistic movements are provided by a gear and linkage system driven by a batter-powered electric motor provided in a housing located below the bed.

BRIEF DESCRIPTION OF DRAWINGS

This invention will now be further described with reference to the following drawings, in which.

DESCRIPTION OF INVENTION

Figure 1:
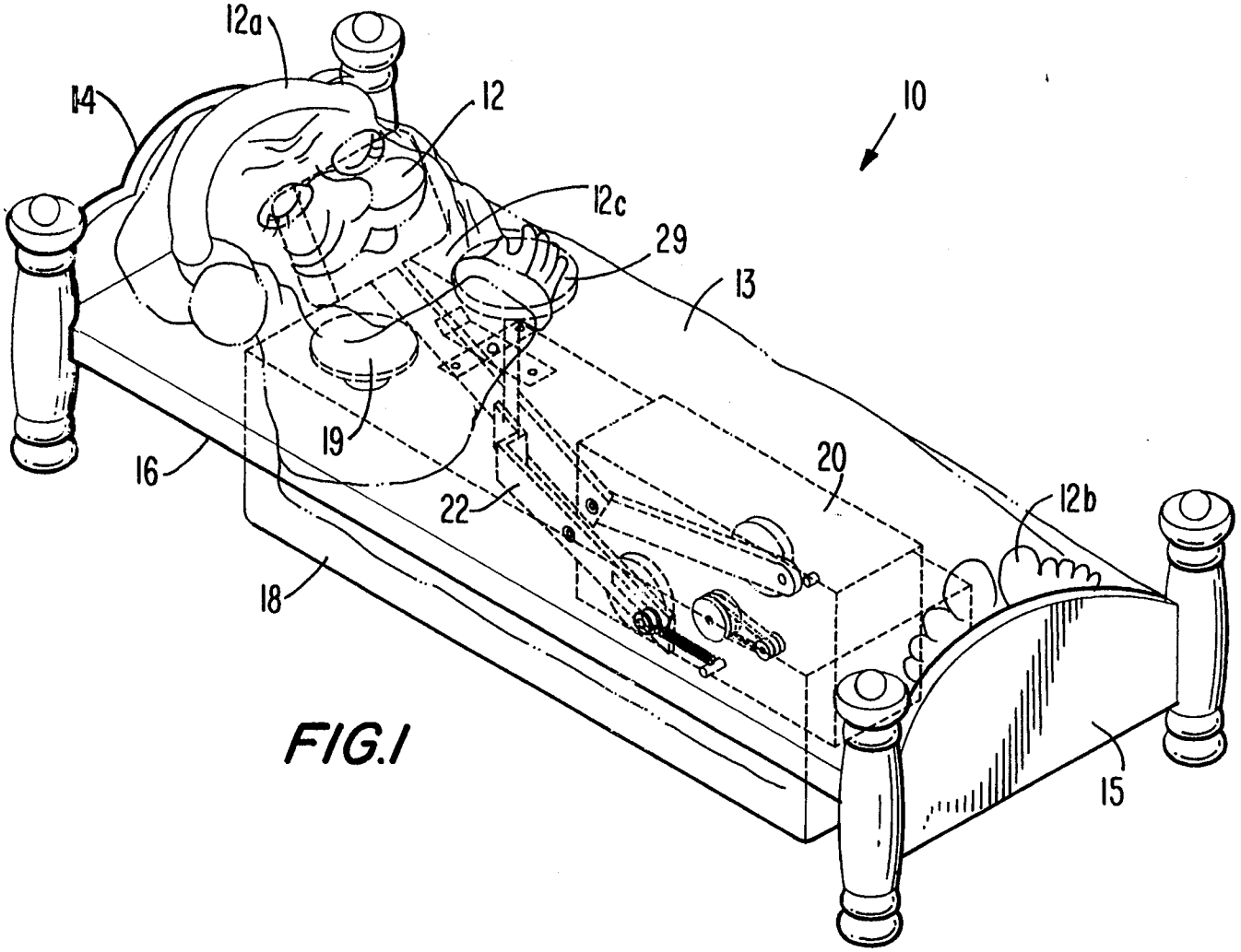
FIG. 1 is a perspective view of a Santa Claus character shown reclining in a bed, with the character actuating mechanism provided below the bed being shown in dotted lines.
Figure 2:
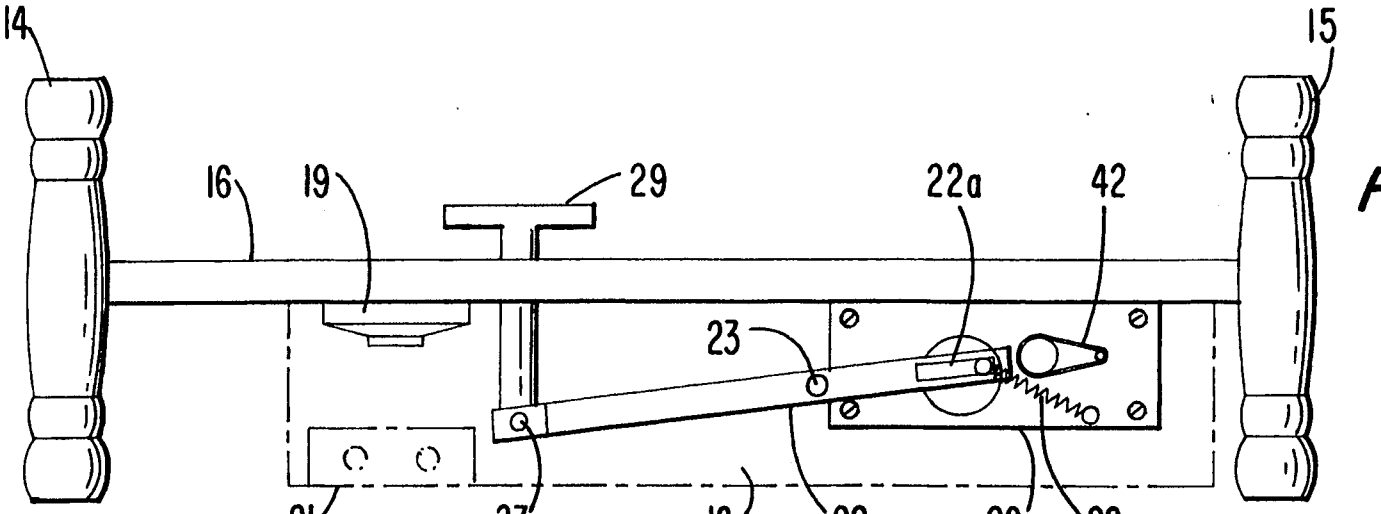
FIGS. 2 and 2A each show a side elevation view of the bed and actuating mechanism causing the chest area of the Santa Claus character to rise and fall during simulated breathing.
Figure 2A:
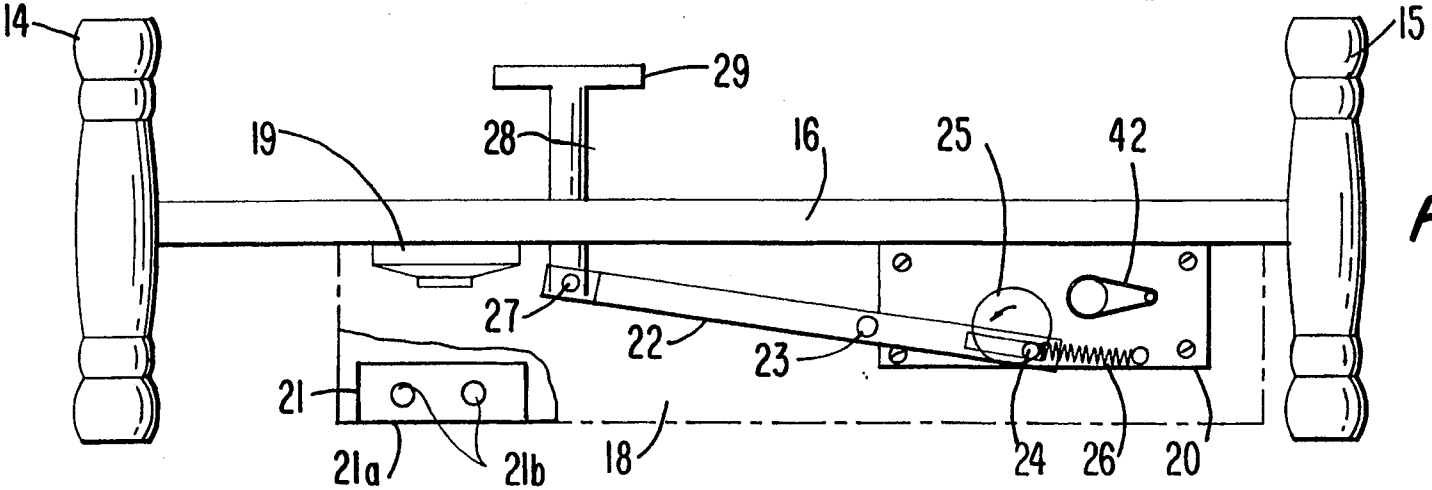

As shown in the FIG. 1, a toy device 10 includes a Santa Claus character or doll 12 having a cap 12*a* and two feet 12*b* extending beyond a central cover sheet 13 and a chest portion 12*c*. The character 12 is reclining in a bed having a headboard 14 and a footboard 15 which support a connecting center piece 16 which is rigidly attached to the two headboards. A rectangular-shaped housing 18 is located below and attached onto the bed centerpiece 16 such as by four screw fasteners (not shown). As better shown in FIGS. 2 and 2*a*, the housing 18 contains an audio speaker unit 19 located below the Santa Claus character torso portion, and a rectangular-shaped gear unit 20 each being attached to the bed center part 16. A rectangular-shaped enclosure 21 having a pivotable cover 21*a* is provided attached to the housing 18 lower side, and contains two dry cell type batteries 21*b*.

An elongated first linkage 22 is pivotably attached at its central point 23 to the forward end of the gear box unit 20 and extends along one side of the gear box unit, and has an elongated slot 22*a* provided at the linkage rearward end. A driving pin 24 is inserted into the slot 22*a* and is attached rigidly to a first rotatable disc 25 at near its periphery. A tension spring 26 is attached to the gear unit 20 and also to the rear end of the first linkage 22. The forward end of the elongated first linkage 22 is pivotably attached at 27 to a vertically actuated member 28 having an enlarged flattened upper portion 29. It will be understood that whenever the rotatable disc 25 is rotated by a motor (not shown), the driving pin 24 will slide back and forth in slot 22*a* of the first linkage 22, while pivoting the linkage 22 at pivot point 23 by action of both the driving pin 24 and spring 26, thereby causing the vertical member 28 to be moved up and down. This vertical movement of member 28 simulates breathing action for the chest portion 12*c* of the Santa Claus doll 12.

Figure 3:
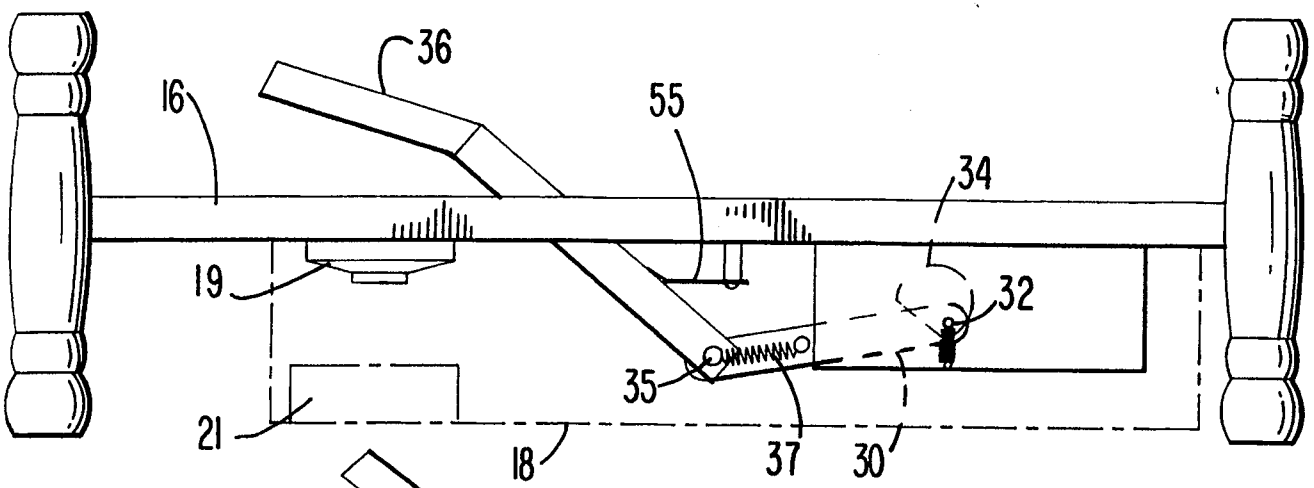
FIG. 3 shows a side elevation view of the bed and actuating mechanism with the Santa Claus character (not shown) being in a reclining or sleeping position in the bed.
Figure 3A:
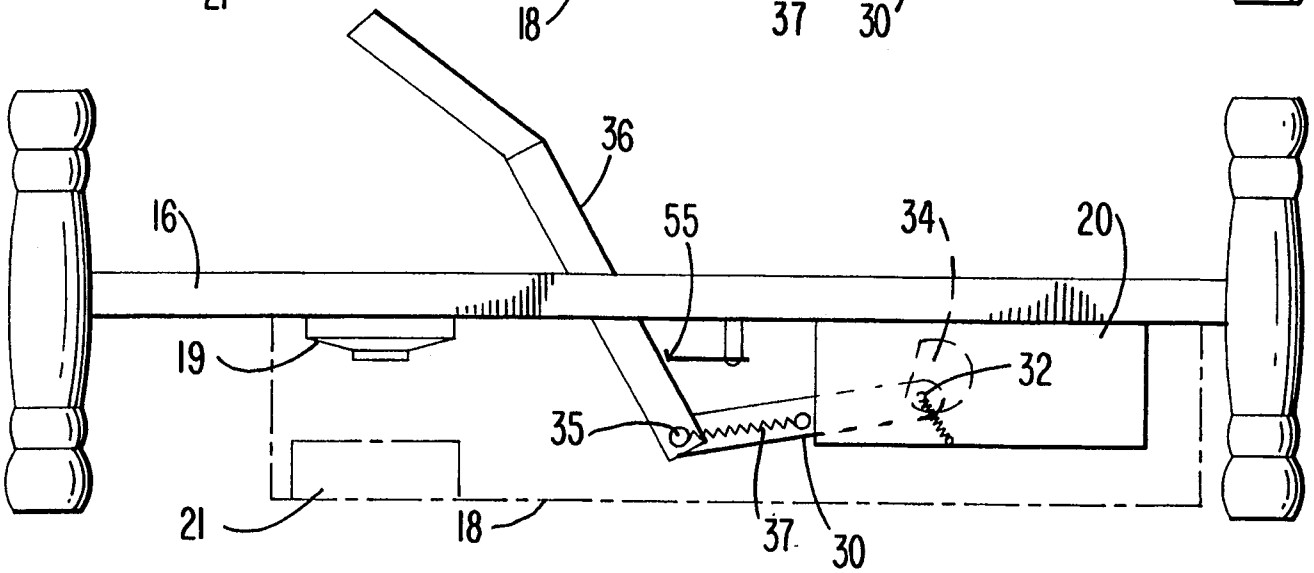
FIG. 3A is a side elevation view similar to FIG. 3 except with the actuating mechanism shown in a raised position.

As best shown in FIGS. 3 and 3A, the gear box unit 20 has provided on its side opposite from the first linkage 22 a second elongated linkage member 30, which is pivotably attached at its rearward end to a drive pin 32 driven by a second rotatable disc 34. The second linkage 30 is pivotably attached at its forward end 35 to a third linkage member 36, which is restrained in its movement by a tension spring 37. It will be understood that when the rotatable drive disc 34 is rotated, second linkage 30 is moved forward and back against the tension force of spring 37, so that the third link member 36 is raised from its lowered position shown in FIG. 3 to the raised position shown in FIG. 3A. This movement of the second linkage member 30 and disc 34 causes the Santa Claus doll 10 head and torso portion to rise upwardly in the bed center part 16 to a near sitting position and then settle back down to a reclining position in the bed.

Figure 4:
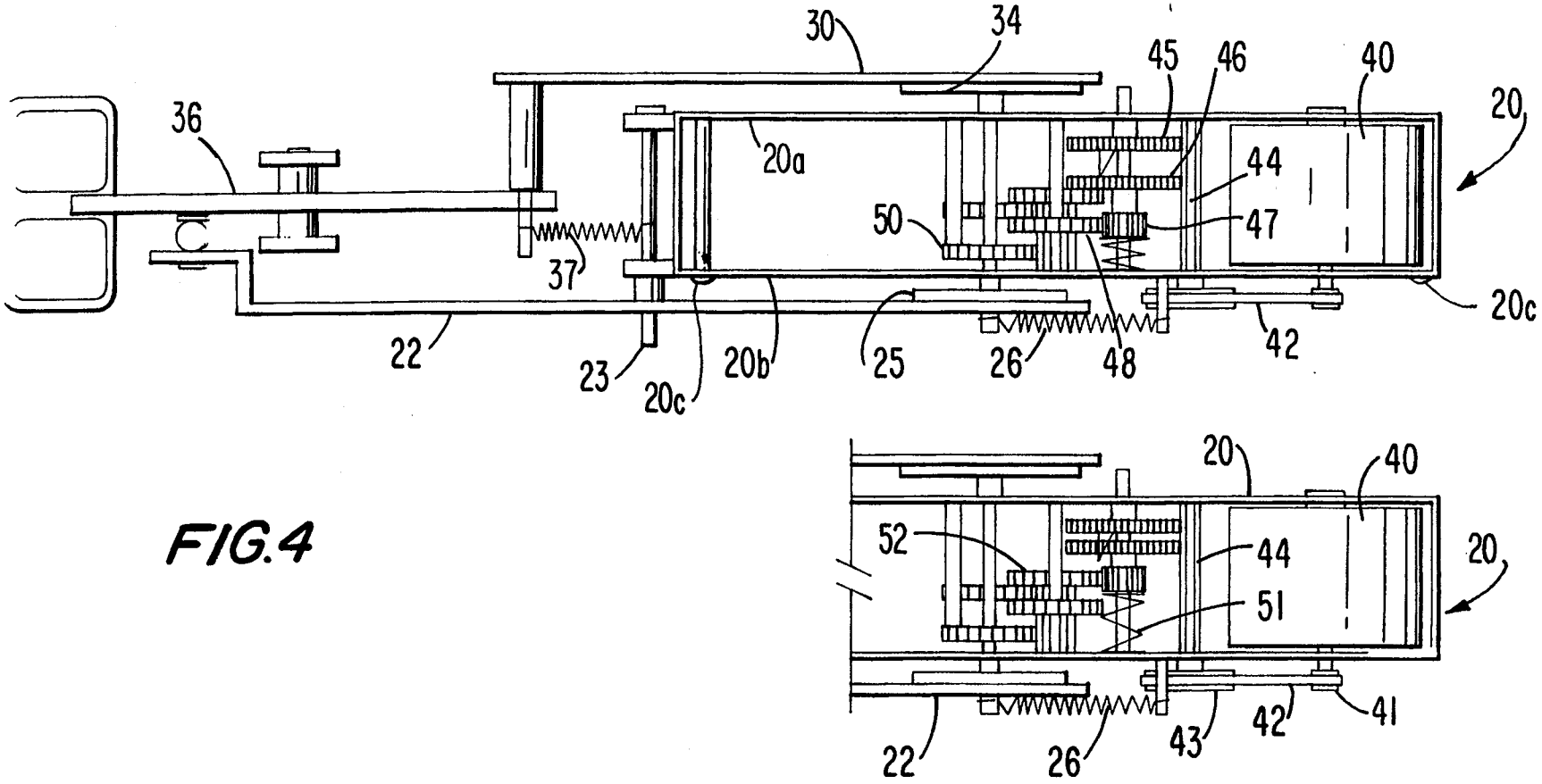
FIG. 4 are plan views of the actuating mechanism used for providing raising and lowering movements for the Santa Claus character in the bed.

As further shown in FIG. 4, the gear box unit 20 consists of dual sides 20*a* and 20*b* which are retained together by threaded fasteners 20*c*. The gear box 20 also contains an electric motor 40 located in the box rearward portion. The motor 40 is arranged to drive an endless belt 42 connecting sheaves 41 and 43, which drive an elongated pinion gear 44 which is rotatable within the gear box 20. The elongated pinion gear 44 drives gears 45 and 46 which are both located on the same shaft together with an axially moveable pinion gear 47 actuated by spring 51 on shaft 47A. As seen in FIG. 4, the pinion gear 47 is meshed with gear 48, pinion 49 and gear 50 which is connected to the first rotatable disc 25. As was previously described, rotatable disc 25 activates the first linkage 22 and vertical member 28 to simulate breathing action by the Santa Claus doll 12.

When it is desired to have the Santa Claus doll 12 raise upwardly to a sitting position in the bed, the pinion gear 47 is moved axially on shaft 47*b* by action of compression spring 51 to mesh with gear 52. This gear 52 causes rotation of the external second rotatable disc 34, which actuates the second linkage member 30 to provide for the periodic rising of the Santa Claus doll 12 upwardly in the bed. The periodic rising of the Santa Claus character 12 in the bed is initiated by a microprocessor circuit board unit 54 which is connected electrically between the battery power source 21*b* and the motor 40. A contact switch 55, which is rigidly mounted onto the bed center piece 16, is closed by contact from linkage member 36, so that second rotary disc 34 is rotated through one complete turn before it and the second linkage member 30 are stopped by the contact switch 55.

Figure 5:
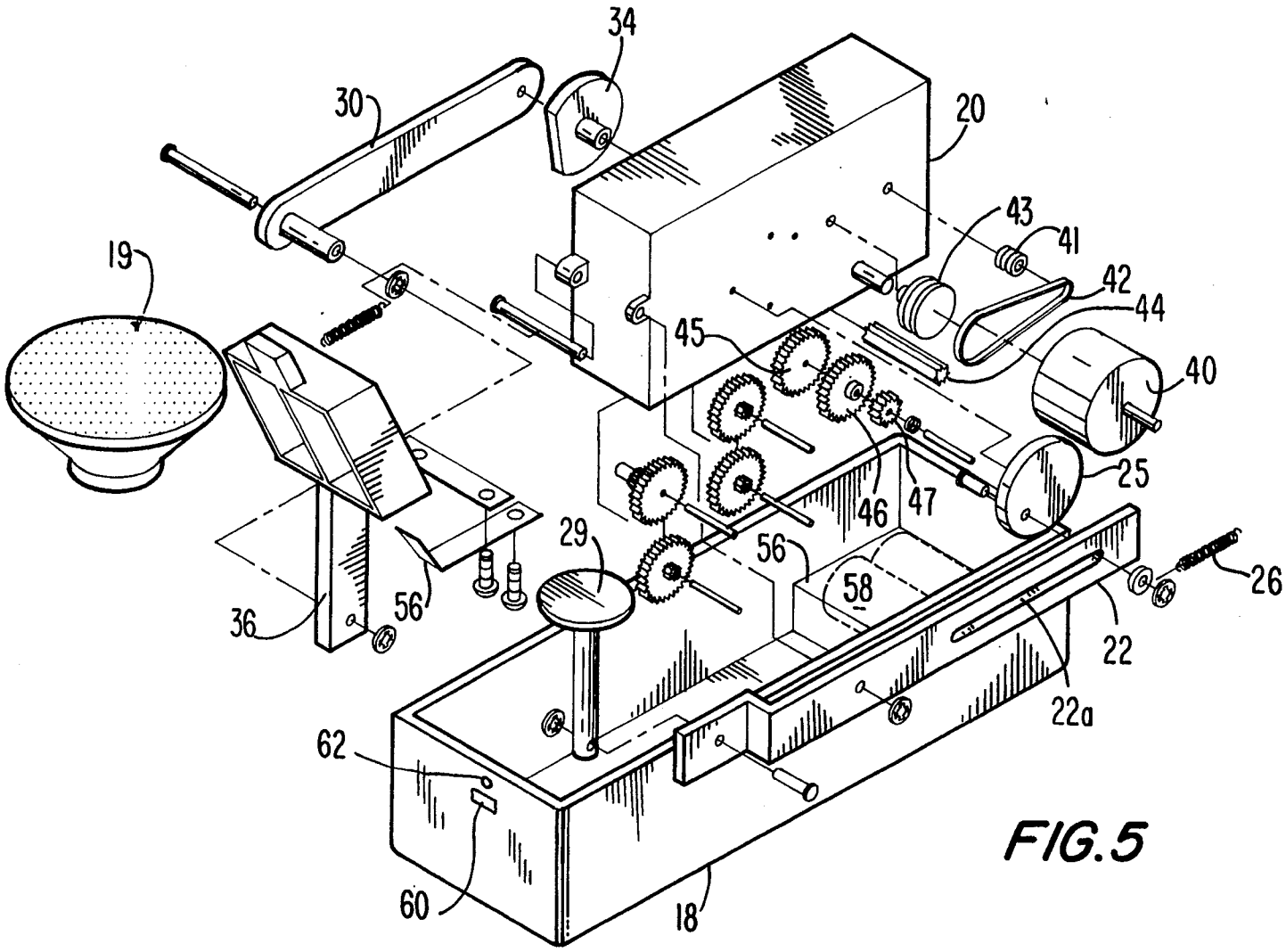
FIG. 5 shows an exploded view of the actuating mechanism and gear unit for providing raising and lowering movements to the Santa Claus character in the bed according to the invention.

The construction and operation of the actuating mechanism and gear box unit 20 contained in housing 18 is further shown in an exploded view by FIG. 5. It is seen that the electric motor 40 in gear box unit 20 drives small sheave 41 and larger sheave 43 through an endless belt 42, so that the sheave 43 drives the elongated pinion gear 44. Pinion gear 44 drives both spur gears 45 and 46 together with axially moveable pinion gear 47. The pinion gear 47 drives either gear 48 or 52 depending upon whether it is desired to have the first linkage 22 driving the vertical member 28 to simulate breathing action or the linkage 30 driving third member 36 to simulate the Santa doll 12 rising up in the bed 16. A rectangular-shaped compartment 56 formed in the lower portion of the housing 18 has a door 57 openable from the bottom and contains two dry cell batteries 58 for operating the electric motor 40 and the speaker device 19. An off-on switch element 60 is provided mounted on the forward end of the housing 18 for controlling operation of the electric motor 40. Also attached to the housing 18 is a plug-in connector 62 useful for providing electric power to the motor 40 from an external source.

The bed head pieces 14, 15 and connecting piece 16 are made of foamed plastic material to provide adequate and sufficient strength and low weight, and housing 18 is made of molded nylon or polyethylene material. The gears can be made of molded nylon material.

This invention will be further described by an Example which should not be construed as limiting in scope.

EXAMPLE

An actuated Santa Claus toy device is provided in which a Santa Claus doll character is reclining and sleeping in a bed. The bed has a housing attached to its lower side and contains a gear box unit and has a dual linkage mechanism operated by an electric motor driven by two 1.5 volt dry cell batteries. The doll character head and torso portion is attached to the linkage mechanism so that a first linkage can periodically raise and lower the doll chest portion so as to simulate breathing action by the doll. An audio device is provided in the housing which is synchronized with the simulated breathing action to simulate snoring by the doll. Also, a second linkage is arranged to raise the doll head and torso portions upwardly to a near sitting position in the bed at periodic intervals 5–10 times the simulated breathing frequency. The bed and housing are constructed of molded polyethylene, and the gear box and gears are constructed of molded nylon material Important characteristics of the actuated toy are as follows:

| | |
|---|---|
| Bed length, in. | 15 |
| Bed width, in. | 6 |
| Bed post height, in. | 6 |
| Doll breathing rate/min. | 50–60 |
| Doll rising frequency/min | 6–8 |

Although this invention has been described broadly and in terms of a preferred embodiment, it is understood that modifications and variations can be made with the scope as defined by the following claims.

I claim:

1. An actuated toy device having a recognizable doll character which is reclining and vertically moveable on a bed, the device comprising:

(a) an elongated bed structure having dual end parts connected together by a center support part;

(b) a doll character having head, chest and torso portions reclining in said bed structure and being partially covered by a covering sheet;

(c) a rectangular-shaped housing removably attached to the lower side of said bed structure, said housing containing a gear box unit and a battery enclosure, said gear box unit containing an electric motor rotatably connected to multiple meshing gears and dual driving discs;

(d) a first linkage member provided along one side of said gear box unit and connected to a first said driving disc, and being arranged to provide vertical reciprocating movements to simulate breathing action by said doll character chest portion; and (e) a second linkage member provided along the side opposite said one side of said gear box unit and connected to a second said driving disc, and being arranged to provide angular movement for a second linkage to cause said doll character head and torso portions to raise periodically upwardly and fall back to a reclining position in said bed.

2. The toy device according to claim 1, wherein said doll character is a Santa Claus figure having head and feet portions each extending beyond a covering sheet.

3. The toy device according to claim 1, wherein said housing contains an audio unit adapted for emitting periodic simulated snoring sounds which are synchronized with the simulated breathing action of said doll character.

4. The toy device according to claim 1, wherein said first linkage member is pivotably attached at its central portion to a front side of said gear box unit, and has an elongated slot at its rear end connected to the first rotatable disc.

5. The toy device according to claim 1, wherein said second linkage member is pivotably attached at its rear end to the second rotatable disc.

6. The toy device according to claim 1, wherein said first linkage includes a tension spring connecting said gear box unit rear end to the rearward end of the first linkage.

7. The toy device according to claim 1, wherein said second linkage includes a tension spring attached between said gear box unit front end and a second link member.

8. The toy device according to claim 5, wherein the periodic rotation of said second rotatable disc is initiated by a timer unit, the second disc turns through one complete revolution, and is stopped by a contact switch actuated by said second linkage.

9. An actuated toy device having a recognizable doll character which is reclining and vertically moveable on a bed, the device comprising:

(a) an elongated bed structure having dual end parts connected together by a center support part;

(b) a Santa Claus character having head chest and torso portions reclining in said bed structure and being partially covered by a covering sheet, said character having head and feet portions each extending beyond the covering sheet;

(c) a rectangular-shaped housing removably attached to the lower side of said bed structure, said housing containing a gear box unit and a battery enclosure, said gear box unit containing an electric motor rotatably connected to multiple meshing gears and dual driving discs;

(d) a first linkage member provided along one side of said gear box unit and connected to a first said driving disc and being arranged to provide regular vertical reciprocating movements to simulate breathing action by said character chest portion;

(e) a second linkage member provided along the side opposite said one side of said gear box unit and connected to a second said driving disc, and being arranged to provide angular movement for a second linkage to cause said doll character head and torso portions to raise periodically upwardly and fall back to a reclining position in said bed; and (f) an audio unit included in said housing and adapted for emitting periodic simulated snoring sounds which are synchronized with the simulated breathing actions of the character.

* * * * *